United States Patent [19]

Hatanaka et al.

[11] Patent Number: 4,903,564

[45] Date of Patent: Feb. 27, 1990

[54] MUSICAL TONE WAVEFORM PRODUCING APPARATUS FOR ELECTRONIC MUSICAL INSTRUMENT

[75] Inventors: Masahiko Hatanaka, Osaka; Daisuke Mori, Kobe; Masahiro Nakanishi, Kyoto, all of Japan

[73] Assignee: Matsushita Electric Industrial Co., Ltd., Japan

[21] Appl. No.: 253,222

[22] Filed: Sep. 28, 1988

[30] Foreign Application Priority Data

Sep. 28, 1987 [JP] Japan ..... 62-243315

[51] Int. Cl.[4] ..... G10H 1/057; G10H 1/06; G10H 1/46; G10H 7/00

[52] U.S. Cl. ..... 84/622; 84/627; 84/633

[58] Field of Search ..... 84/1.01, 1.09–1.13, 84/1.19–1.28

[56] References Cited

U.S. PATENT DOCUMENTS 4,524,668 6/1985 Tomisawa et al. ..... 84/1.24
4,528,885 7/1985 Chihana ..... 84/1.1
4,616,546 10/1986 Uchiyama et al. ..... 84/1.01
4,726,276 2/1988 Katoh et al. ..... 84/1.19

*Primary Examiner*—Stanley J. Witkowski
*Attorney, Agent, or Firm*—Lowe, Price, LeBlanc, Becker & Shur

[57] ABSTRACT

In a musical tone waveform producing apparatus having an operating device for receiving an instruction from a user, a waveform memory, a waveform control circuit for reading out tone-color waveform data from the waveform memory, an envelope memory, an envelope control circuit for reading out the envelope data from the envelope memory, and a multiplier for producing a resultant waveform, tone-color waveform data formed of a number of waveform data blocks each having an attenuation flag is prestored in the waveform memory and the attenuation flag is received by the envelope control circuit to produce attenuated envelope data while the attenuation flag is valid and to output the envelope data read out of the envelope memory while the attenuation flag is invalid. As a result, the resultant waveform has no undesirable noise component caused by the following tone-color waveform data.

8 Claims, 5 Drawing Sheets

MUSICAL TONE WAVEFORM PRODUCING APPARATUS FOR ELECTRONIC MUSICAL INSTRUMENT

BACKGROUND OF THE INVENTION

1. Field of the Invention

This invention relates generally to an electronic musical instrument and particularly to a musical tone waveform producing apparatus for using in a waveform-reading-type electronic musical instrument.

2. Prior Art

A digital technology in electronic musical instruments is rapidly improved recently. Particularly, a waveform-reading method, in which a musical sound is produced by respectively reading prestored tone-color waveform data and prestored envelope data from a waveform memory and an envelope memory, is popularly used together with a PCM method in the electronic musical instruments.

However, in a conventional musical tone waveform producing apparatus for electric musical instruments, the time length of each of tone-color waveform data is difficult to equalize with that of each of envelope data. In order to achieve a correct time adjustment, the number of bit of envelope data block is necessarily increased so that an envelope control circuit becomes complicated therefor. In addition, there is drawback that if the same envelope data is used when a tone is of high pitch, since a frequency due to frequency information becomes high, the time period of one tone-color waveform data becomes short. Accordingly, a resultant waveform has an undesirable noise component which is caused by the following tone-color waveform data.

SUMMARY OF THE INVENTION

The present invention has been developed in order to remove the above-described drawbacks inherent to the conventional musical tone waveform producing apparatus for electronic musical instruments.

It is, therefore, an object of the present invention to provide a new and useful musical tone waveform producing apparatus in which the attenuation of a musical sound is completely actualized by utilizing an attenuation flag preset in a waveform data block stored in a waveform memory.

It is another object of the invention to provide a musical tone waveform producing apparatus in which undesirable noise component is not produced when a tone pitch is changed.

In accordance with the present invention there is provided a musical tone waveform producing apparatus for use with an operating device for receiving an instruction from a user, and producing a key-ON signal, tone-color information, frequency information, and amplitude information, the apparatus comprising: a waveform memory storing tone-color waveform data formed of a number of waveform data blocks each having an attenuation flag; a waveform control circuit responsive to the key-ON signal, the tone-color information, and the frequency information for selectively reading out the tone-color waveform data in accordance with the frequency information, and for outputting the read out tone-color waveform data and the attenuation flag; an envelope memory storing envelope data formed of a number of waveform data blocks; an envelope control circuit responsive to the key-ON signal and the amplitude information for selectively read out the envelope data in accordance with the amplitude information, the envelope control circuit being responsive to the attenuation flag for producing attenuated envelope data in response to a given state of the attenuation flag and for outputting the envelope data read out of the envelope memory as it is in response to the other state of the attenuation flag, the attenuated envelope data and the envelope data without attenuation being outputted as a controlled-envelope output; and a multiplier responsive to the tone-color waveform data from the waveform control circuit and the controlled-envelope output from the envelope control circuit for producing a resultant waveform.

BRIEF DESCRIPTION OF THE DRAWINGS

The object and features of the present invention will become more readily apparent from the following detailed description of the preferred embodiment taken in conjunction with the accompanying drawings in which.

The same or corresponding elements and parts are designated at like reference numerals throughout the drawings.

DETAILED DESCRIPTION OF THE INVENTION

Prior to describing the preferred embodiment of the present invention, the above-mentioned conventional musical tone waveform producing apparatus will be described for a better understanding of the present invention.

Figure 4:
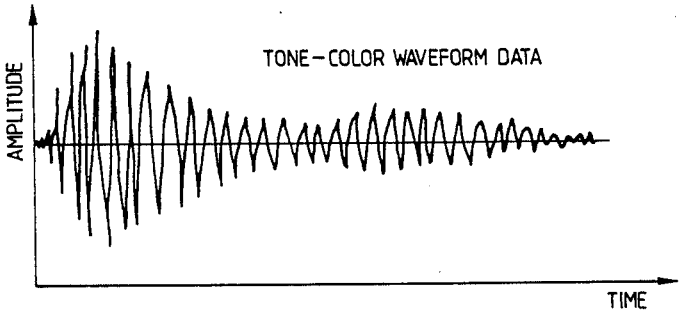
FIG. 4 PRIOR ART
FIG. 4 is one tone-color waveform data stored in a waveform memory.
Figure 5:
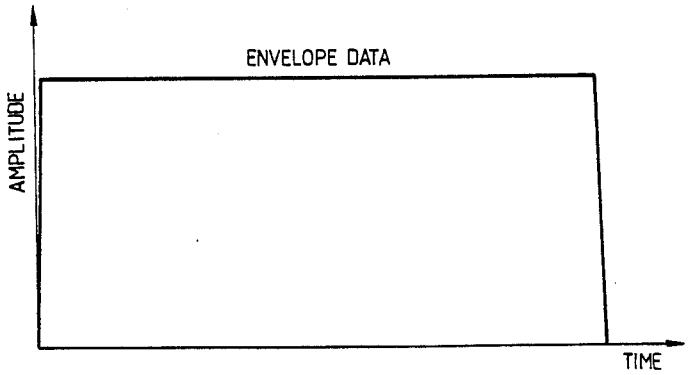
FIG. 5 PRIOR ART
FIG. 5 is one envelope data stored in an envelope memory.
Figure 3:
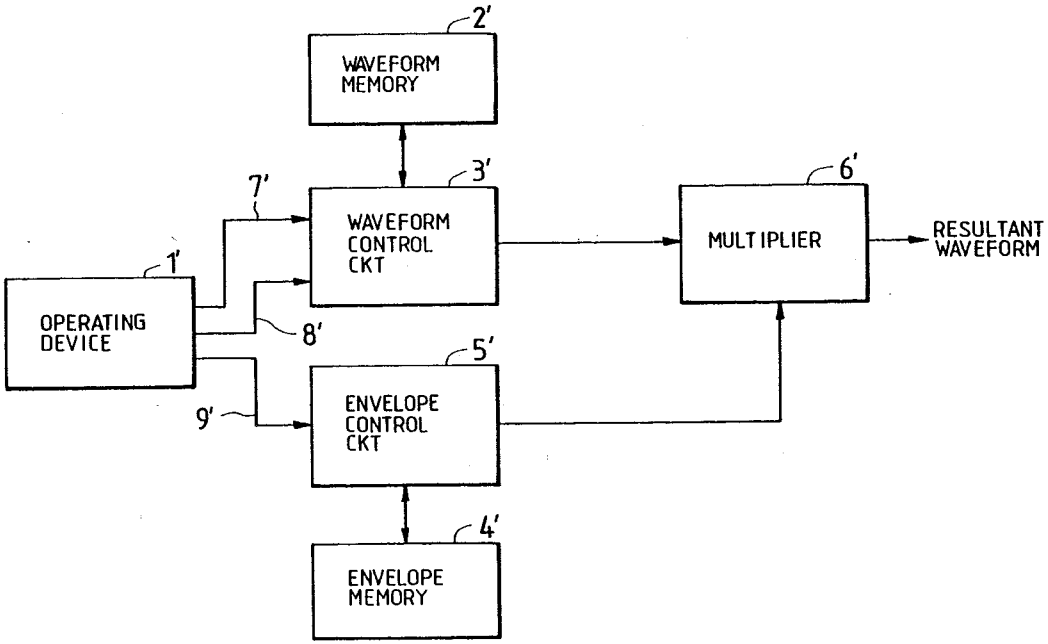
FIG. 3 PRIOR ART
FIG. 3 is a block diagram of a conventional musical tone waveform producing apparatus for electronic musical instruments.
Figure 6:
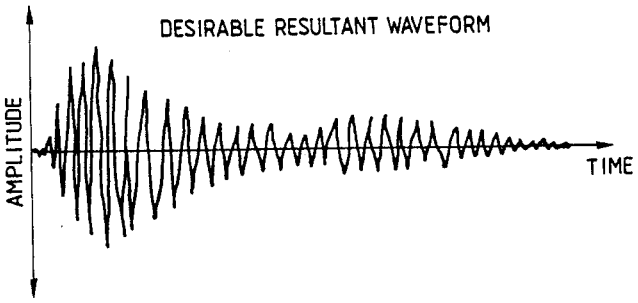
FIG. 6 PRIOR ART
FIG. 6 is a desirable resultant waveform produced by a conventional musical tone waveform producing apparatus.

FIG. 3 is a block diagram showing a conventional musical tone waveform producing apparatus. In FIG. 3, the conventional musical tone waveform producing apparatus generally comprises an operating device 1' for receiving an instruction from a user, a waveform memory 2', a waveform control circuit 3', an envelope memory 4', an envelope control circuit 5', and a multiplier 6'. The operating device 1' includes a keyboard and an information output device (not shown) for example. Tone-color waveform data is prestored in the waveform memory 2', and envelope waveform data is prestored in the envelope memory 4'. One example of the tone-color waveform data is shown in FIG. 4, and one example of the envelope waveform data is shown in FIG. 5. In the operation of this musical tone waveform producing apparatus, when a key of the keyboard is pushed, the operating device 1' produces tone-color information 7', frequency information 8', and amplitude information 9'. Then, the tone-color information 7' and frequency information 8' are sent to the waveform control circuit 3' and the amplitude information 9' is sent to the envelope control circuit 5' in accordance with such a pushed key. In the waveform control circuit 3', tone-color waveform data is received from the waveform memory 2' in accordance with tone-color information 7' sent from the operating device 1' at the frequency of the frequency information 8' sent from the operating device 1'. In the envelope control circuit 5', envelope data is subsequently received from the envelope memory 4' in accordance with such amplitude information 9' sent from the operating device 1'. Such received tone-color waveform data and such received envelope data are respectively subsequently sent to the multiplier 6'. As a result, a resultant waveform is produced as shown in FIG. 6.

Figure 7:
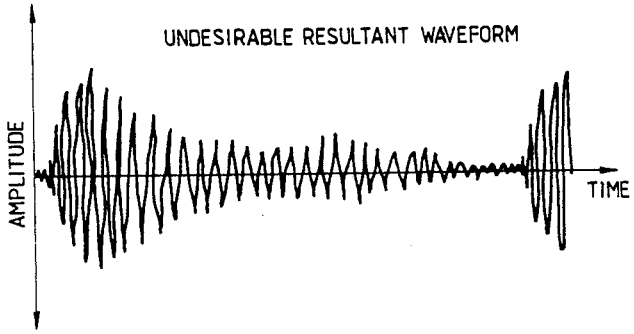
FIG. 7 PRIOR ART
FIG. 7 is a undesirable resultant waveform produced by the conventional musical tone waveform producing apparatus.

In such a conventional musical tone waveform producing apparatus, the time length of one tone-color waveform data has to be predetermined so as to be equalized with the time length of one envelope data. Generally, the time length of one envelope data is adjusted to be equalized to the time length of one tone-color waveform data. Therefore, since a correct time adjustment is required, the number of bit of the envelope data is necessarily increased so that the envelope control circuit 5' becomes complicated therefor. Besides, if the same envelope data is used when a tone is of high pitch, since a frequency due to the frequency information 9' becomes high, the time length of one tone-color waveform data becomes short. Accordingly, a resultant waveform derived from the multiplier 6' has an undesirable noise component which is caused by the following tone-color waveform data as shown in FIG. 7.

In order to avoid the above-mentioned drawbacks, there is a method in which the envelope data is changed in accordance with each tone pitch, and another method in which the time length of the envelope data is compensated in accordance with each tone pitch. However, the capacity of the envelope memory 4' becomes large by storing a number of further envelope data, and another circuit is required for compensating for the time length of the envelope data.

Figure 1A:
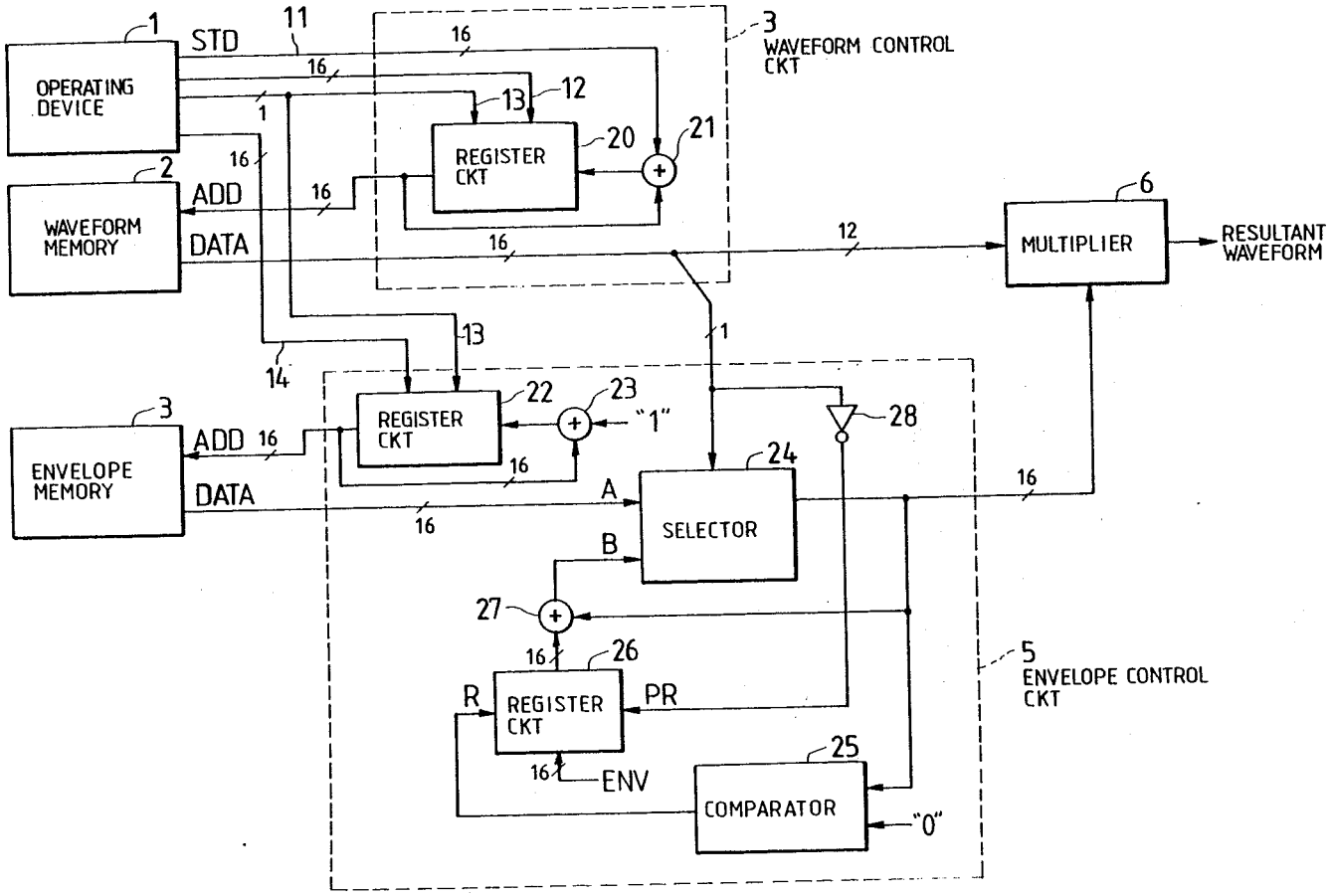
FIG. 1A is a block diagram of a musical tone waveform producing apparatus for electronic musical instruments according to the present invention.
Figure 1B:
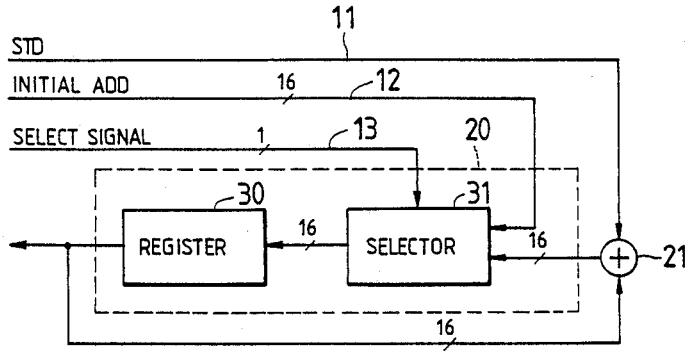
FIG. 1B is a block diagram of a register circuit in a waveform control circuit of FIG. 1.
Figure 1C:
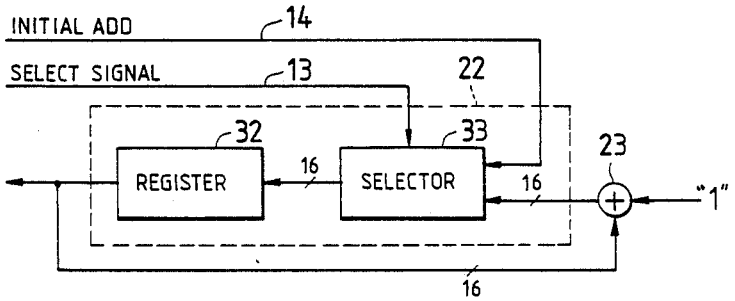
FIG. 1C is a block diagram of a first register circuit in an envelope control circuit of FIG. 1.
Figure 1D:
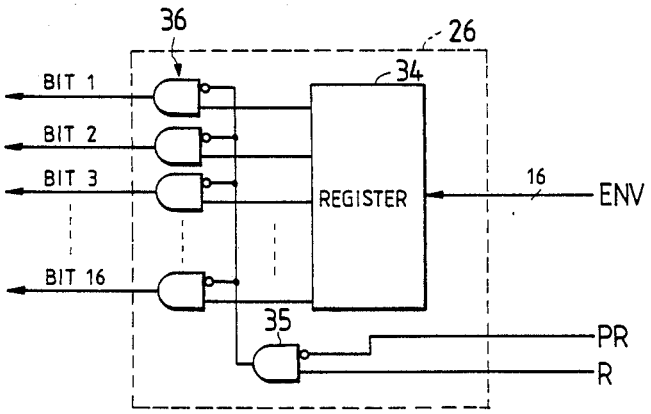
FIG. 1D is a block diagram of a second register circuit in the envelope control cirucit of FIG. 1.
Figure 2:
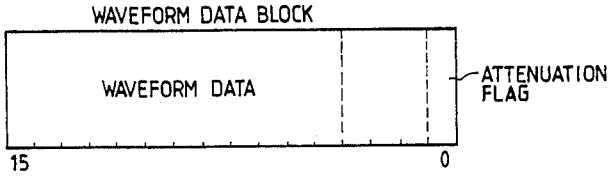
FIG. 2 is a waveform data block used in the present invention.

Referring now to FIG. 1A, a musical tone waveform producing apparatus according to the present invention generally comprises an operating device 1 including a keyboard and an information output device (not shown), a waveform memory 2 for storing tone-color waveform data, a waveform control circuit 3, an envelope memory 4 for storing an envelope data, an envelope control circuit 5, and a multiplier 6. The waveform control circuit 3 includes a register circuit 20 and an adder 21. The envelope control circuit 5 includes a first register circuit 22, an adder 23, a selector 24, a comparator 25, a second resister circuit 26, an adder 27, and an inverter 28. FIG. 1B is a block diagram of the register circuit 20, and FIG. 1C and FIG. 1D are respective block diagram of first and second registers circuits 22 and 26. The register circuit 20 has a register or memory 30 and a selector 31, and the first register circuit 22 has a register or memory 32 and a selector 33. Furthermore the second register has a register 34, sixteen gates 36, and a gate 35. The output from the gate 35 is connected to one of two input terminals of each gate 36. The output from the register 34 is connected to the other input terminal of each gate 36 by one bit. One example of the tone-color waveform data is shown in FIG. 4, and one example of the envelope data is shown in FIG. 5. Both the tone-color waveform data and the envelope data are respectively formed of a number of waveform data blocks. Each data block is formed of sixteen bits as shown in FIG. 2, and includes twelve bits waveform data and one bit attenuation flag. This attenuation flag indicates whether tone-color waveform data is to be attenuated or not. A given state of attenuation flag "1" or the other state thereof "0" is previously set in each tone-color waveform data block, and data blocks each having an attenuation flag value "1" are placed in all data blocks from near the terminated portion of one tone-color waveform data to the end thereof. The position of the attenuation flag value "1" is different in the kind of tone-color. In addition, a signal "1" is always applied to the adder 23 for the address increment of the register circuit 22, and a signal "0" is always applied to the comparator 25 as a reference data. Besides, predetermined negative attenuation data ENV is also always applied to the register circuit 26 for the attenuation of the amplitude of the envelope data.

The operation of the musical tone waveform producing apparatus having the above-mentioned structure according to the present invention will be described with reference to FIGS. 1A, 1B, 1C, and 1D hereinbelow. When the operating device 1 receives an instruction from a user, e.g. when a key of the keyboard is pushed by the user, the operating device 1 produces tone-color information 12 of the piano, the guitar, the violin, or the like, frequency information (STD) 11 thereof, amplitude information 14 i.e. volume information thereof, and a key-ON signal operating as a select signal 13 of the selectors 31 and 33. The tone-color information indicates an initial address in which each tone-color information is stored in the waveform memory 2, and the amplitude information indicates an initial address in which each amplitude information thereof is stored in the envelope memory 3. The select signal 13 is a pulse signal whose state "1" only when the key-ON signal changes "0" to "1". The initial address of the tone-color information 12, the select signal 13, the frequency information 11 are sent to the waveform control circuit 3, and the initial address of the amplitude information 14 and the select signal 13 are sent to the envelope control circuit 5.

In the waveform control circuit 3, the frequency information 11 is sent to the adder 21, and the initial address of the tone-color information 12 and the select signal 13 are sent to the selector 31 to determine the first address of one tone-color waveform data which is selectively read out of the waveform memory 2 as shown in FIG. 1B. When the select signal 13 is "1", the selector 31 outputs such tone-color initial address which indicates the first address of the waveform memory 2 to the register 30. Then, the register 30 outputs the first address to the waveform memory 2 so that tone-color waveform data formed of sixteen bits is read out of the waveform memory 2. At this time, the initial address is also sent to the adder 21. The adder 21 operates for the increment of the address of the tone-color waveform data in accordance with the frequency information 11, because the select pulse signal 13 is changed "1" to "0" after the selector 31 outputs the initial address. Therefore, the added address outputted from the adder 21 is selected in the selector 31 to be outputted to the register 30. Thus, the register circuit 20 subsequently reads the tone-color waveform data from the waveform memory 2.

One bit attenuation flag is sent to the envelope control circuit 5, and the twelve bits waveform data is sent to the multiplier 6. At this time, the attenuation flag is "0". As will be seen from the above description, the register circuit 20 and the adder 21 are operated as an address determining means for subsequently determining addresses of said waveform memory. The above-mentioned operation is repeated until the reset of the register circuit 20 due to the subsequent initial address of tone-color waveform data, i.e. until the key-ON signal changes to "1" again.

In the envelope control circuit 5, the initial address of the amplitude information 14 and the select signal 13 are sent to the selector 33 to determine the first address of one envelope data which is selectively read out of the envelope memory 3 as shown in FIG. 1C. When the select signal 13 is "1", the selector 33 outputs such amplitude initial address which indicates the first address of the envelope memory 3 to the register 32. Then, the register 33 outputs the first address of envelope data to the envelope memory 3 so that envelope data formed of sixteen bits is read out of the envelope memory 3. At this time, the initial address of the envelope data is also sent to the adder 23. The adder 23 operates for the increment of the address of the envelope data in accordance with the the signal "1", in the similar manner to the above-mentioned operation of the register circuit 20. Therefore, the added address outputted from the adder 23 is selected in the selector 33 to be outputted to the register 32. Thus, the first register circuit 22 subsequently reads the envelope data from the envelope memory 3.

The attenuation flag sent from the waveform control circuit 3 is sent to the selector 24 and the inverter 28. Thus, such envelope data without attenuation sent from the envelope memory 3 is sent, via a port A of the selector 24, to the multiplier 6. At this time, since the port A is selected, the attenuation flag is of "0", or invalid. As will be seen from the above description, the register circuit 22 and the adder 23 are operated as another address determining means for subsequently determining address of the envelope memory 3. The above-mentioned operation is repeated until the reset of the register circuit 22 due to the subsequent initial address of envelope data, i.e. until the key-ON signal changes "1" again. In the multiplier 6, the tone-color waveform data outputted from the waveform control circuit 3 is multiplied by the envelope data outputted from the selector 3 in the envelope control circuit 5 to subsequently produce a resultant waveform.

Figure 8:
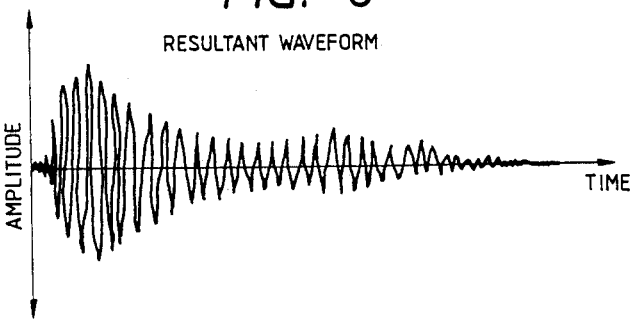
FIG. 8 is a resultant waveform produced by the musical tone waveform producing apparatus of the present invention.

When the attenuation flag becomes valid, or "1", a port B is selected in the selector 24 in the envelope control circuit 5. Here, in the register circuit 26, a signal "0" which is inverted from the valid signal "1" at the inverter 28 is inputted into the gate 35 for outputting sixteen bits data BIT 1 to BIT 16 via the sixteen gates 36 as shown in FIG. 1D. At this time, since the negative attenuation data ENV is always inputted into the register 34, the present data ENV is outputted to the adder 27. Then, in the adder 27, the data value of the register circuit 26, i.e. the predetermined negative attenuation data ENV is added to the present envelope data. It means that the predetermined attenuation data ENV is subtracted from the present envelope data. Therefore, the adder 27 outputs such subtracted envelope data to the port B of the selecter so that the subtracted envelope data is sent to the multiplier 6 via the selector 24. Since this operation is repeated while the attenuation flag is valid, subsequently attenuated envelope data is outputted to the multiplier 6. In the multiplier 6, the tone-color waveform data outputted from the waveform control circuit 3 is multiplied by the above-mentioned cocontrolled-envelope data outputted from the selector 33 in the envelope control circuit 5 so that the resultant waveform can be subsequently attenuated as shown in FIG. 8.

Besides, the present envelope data is also inputted into the comparator 25. In the comparator 25, the present envelope data is always compared with the reference data value "0". When the attenuation flag is "1", i.e. the preset signal "0" is inputted into the gate 35, if the present envelope data is "0", since the comparator 25 outputs a signal "1" to the gate 35 of the register 26 as shown in FIG. 1D, the register circuit 26 is reset so that the adder 26 also outputs the data value "0". Accordingly, the amplitude of the resultant waveform outputted from the multiplier 6 is also 0. Thus, the selector 24, the comparator 25, the register circuit 26, the adder 27, and the inverter 28 are operated as an attenuation means, and the envelope control cirucit 5 outputs such controlled-envelope data to the multiplier 6.

As will be understood from the above description, in the envelope control circuit 5, the amplitude information is received for reading out the envelope data from the envelope memory 3 in accordance with the amplitude information, and the attenuation flag is received for attenuating the envelope data read out of the envelope memory while the attenuation flag is valid.

In this embodiment of a musical tone waveform producing apparatus, although the predetermined negative attenuation data ENV is set to the register circuit 26 while the attenuation flag is valid, attenuation envelope data may be subsequently read out of the envelope memory 3 with the attenuation envelope data being prestored in the envelope memory 3. In this case, an attenuation address register circuit for the envelope data is required to store the attenuation flag therein, and the initial address of such attenuation envelope data is inputted into the attenuation address register circuit.

The above-described embodiment is just one example of the present invention, and therefore, it will be apparent for those skilled in the art that many modifications and variations may be made without departing from the scope of the present invention.

What is claimed is:

1. A musical tone waveform producing apparatus for use with an operating device for receiving an instruction from a user, said operating device producing a key-ON signal, tone-color information, frequency information, and amplitude information, said apparatus comprising:

(a) a waveform memory storing tone-color waveform data formed of a number of waveform data blocks each having an attenuation flag, each attenuation flag having one of two states;

(b) a waveform control circuit responsive to said key-ON signal, said tone-color information, and said frequency information for selectively reading out from said waveform memory said tone-color waveform data in accordance with said frequency information, and for outputting said read out tone-color waveform data and an attenuation flag;

(c) an envelope memory storing envelope data formed of a number of waveform data blocks;

(d) an envelope control circuit responsive to said key-ON signal and said amplitude information for selectively reading out said envelope data in accordance with said amplitude information, said envelope control circuit being responsive to each one of said attenuation flags for producing attenuated envelope data in response to a given state of one of said attenuation flags and for outputting said envelope data read out of said envelope memory as it is in response to the other state of said one attenuation flag, said attenuated envelope data and said envelope data without attenuation being outputted as a controlled-envelope output; and (e) a multiplier responsive to said tone-color waveform data from said waveform control circuit and said controlled-envelope output from said envelope control circuit for producing a resultant waveform.

2. A musical tone waveform producing apparatus as claimed in claim 1, wherein said waveform control circuit includes an address determining means having a register circuit and an adder for subsequently determining addresses of said waveform memory.

3. A musical tone waveform producing apparatus as claimed in claim 1, wherein said envelope control circuit includes:

(i) an address determining means having a first register circuit and a first adder for subsequently determining an address of said envelope memory; and (ii) an attenuation means including a selector having two input ports, said selector responsive to said one attenuation flag and to said envelope data inputted into one input port thereof for selecting one of said two input ports and for outputting data inputted into said one of said two input ports thereof, a second register circuit responsive to output from said waveform control circuit and a predetermined negative attenuation data for outputting said predetermined negative data in response to said output from said waveform control circuit, and a second adder responsive to said output data from said selector and to said output from said second register circuit for producing an attenuation data sent to the other of said two input ports of said selector.

4. A musical tone waveform producing apparatus as claimed in claim 3, wherein said attenuation means further includes a comparator for comparing said output from said selector with a data of zero so that after said output from said selector changes to zero, said selector outputs zero until said one attenuation flag is in said given state.

5. A musical tone waveform producing apparatus comprising:

a memory storing first and second predetermined signals, the first signal representing a waveform, the second signal representing a degree of attenuation;

means for simultaneously reading the first and second signals from the memory;

means, responsive to the read second signal, for generating a third signal representing an envelope which varies in accordance with the degree of attenuation represented by the read second signal; and means for combining the read first signal and the generated third signal into a fourth signal representing a tone which depends on the waveform and the envelope represented by the read first signal and the generated third signal, respectively.

6. A musical tone waveform producing apparatus comprising:

a memory storing a first signal having a first component and a second component, the first component representing a waveform, the second component representing a degree of attenuation;

means for reading the first signal from the memory;

means for separating the read first signal into the first component and the second component;

means, responsive to the separated second component of the first signal, for generating a second signal representing an envelope which varies in accordance with the degree of attenuation represented by the separated second component of the first signal; and means for combining the separated first component of the first signal and the generated second signal into a third signal representing a tone which depends on the waveform and the envelope represented by the read first component of the first signal and the generated second signal, respectively.

7. A musical tone waveform producing apparatus comprising:

a first memory storing first and second predetermined signals, the first signal representing a waveform, the second signal representing a degree of attenuation;

means for simultaneously reading the first and second signals from the first memory;

a second memory storing third signal representing a first envelope;

means for reading the third signal from the second memory in synchronism with the reading of the first and second signals from the first memory;

means for generating a fourth signal representing a second envelope smaller in level than the first envelope;

means for selecting one of the read third signal and the generated fourth signal in accordance with the read second signal; and means for combining the read first signal and said selected one of the read third signal and the generated fourth signal into a fifth signal representing a tone which depends on the waveform represented by the read first signal and which depends on the envelope represented by said selected one of the read third signal and the generated fourth signal.

8. A musical tone waveform producing apparatus comprising:

a first memory storing a first signal having a first component and a second component, the first component representing a waveform, the second component representing a degree of attenuation;

means for reading the first signal from the first memory;

means for separating the read first signal into the first component and the second component;

a second memory storing a second signal representing a first envelope;

means for reading the second signal from the second memory in synchronism with the reading of the first signal from the first memory;

means for generating a third signal representing a second envelope which is smaller in level than the first envelope;

means for selecting one of the read second signal and the generated third signal in accordance with the separated second component of the first signal; and means for combining the separated first component of the first signal and said selected one of the read second signal and the generated third signal into a fourth signal representing a tone which depends on the waveform represented by the separated first component of the first signal and which depends on the envelope represented by said selected one of the read second signal and the generated third signal, whereby a noise component caused in one tone-color waveform by a following tone-color waveform data is eliminated.

* * * * *